US005961042A

United States Patent [19]

Doyle

[11] Patent Number: 5,961,042

[45] Date of Patent: Oct. 5, 1999

[54] WATER ON FIRE APPEARING WATER DISPLAYS

[75] Inventor: James Doyle, Burbank, Calif.

[73] Assignee: WET Enterprises, Inc., Universal City, Calif.

[21] Appl. No.: 09/071,668

[22] Filed: May 1, 1998

[51] Int. Cl.[6] ..... F21P 7/00; B05D 17/08

[52] U.S. Cl. ..... 239/12; 239/211; 239/17

[58] Field of Search ..... 239/17, 18, 12, 239/211; 126/500, 508; 40/407

[56] References Cited

U.S. PATENT DOCUMENTS

| | | | |
|---|---|---|---|
| 634,569 | 10/1899 | Brainard . | |
| 2,270,442 | 1/1942 | Jares . | |
| 3,215,186 | 11/1965 | Levitt . | |
| 3,640,472 | 2/1972 | Hruby, Jr. et al. . | |
| 3,645,449 | 2/1972 | Hruby, Jr. | 239/17 |
| 3,683,887 | 8/1972 | Sammut . | |
| 3,705,686 | 12/1972 | Hruby, Jr. . | |
| 3,782,629 | 1/1974 | Hruby, Jr. . | |
| 3,784,101 | 1/1974 | Frempter . | |
| 4,056,348 | 11/1977 | Wolfe . | |
| 4,145,180 | 3/1979 | Bendorf . | |
| 4,249,884 | 2/1981 | Cade . | |
| 4,304,545 | 12/1981 | Matthews . | |
| 4,635,897 | 1/1987 | Gallant . | |
| 4,858,826 | 8/1989 | Robinson et al. | 239/18 |
| 4,872,611 | 10/1989 | Robinson et al. . | |
| 5,092,312 | 3/1992 | Zolow | 126/500 |
| 5,524,822 | 6/1996 | Simmons | 239/17 |

FOREIGN PATENT DOCUMENTS

| | | |
|---|---|---|
| 45-19351 | 7/1970 | Japan . |
| 1186278 | 10/1985 | U.S.S.R. . |

*Primary Examiner*—Andres Kashnikow
*Assistant Examiner*—Davis Hwn
*Attorney, Agent, or Firm*—Blakely, Sokoloff, Taylor & Zafman LLP

[57] ABSTRACT

Water on fire appearing water displays characterized by a burning fuel/air mixture entrained in a stream of water. The display uses a self entraining nozzle disposed at a proper level in a body of water, with a source of flammable gas provided a flow of gas to the lower pressure portion of the air entraining region of the nozzle and with the proper flow rate to obtain a combustible mixture of fuel/air entrained in the air stream. Coordinated variation of the water and gas flow under computer control provided a dynamic display while maintaining the flame throughout the variations. Other features are disclosed.

8 Claims, 3 Drawing Sheets

WATER ON FIRE APPEARING WATER DISPLAYS

BACKGROUND OF THE INVENTION

1. Field of the Invention

The present invention relates to the field of water displays.

2. Prior Art

Water displays of various kinds are well known in the prior art, ranging from ancient fountains to very dynamic computer-controlled displays of various kinds. Some water displays, in addition, have incorporated fire in one form or another as part of the display. Examples of such displays include that found in U.S. Pat. No. 4,858,826. Such prior art displays generally each have their own characteristic. In that regard, the purpose of the present invention is to create a relatively inexpensive display which combines fire and water in a manner creating the illusion of the water itself burning.

BRIEF SUMMARY OF THE INVENTION

Water on fire appearing water displays characterized by a burning fuel/air mixture entrained in a stream of water. The display uses a self entraining nozzle disposed at a proper level in a body of water, with a source of flammable gas provided a flow of gas to the lower pressure portion of the air entraining region of the nozzle and with the proper flow rate to obtain a combustible mixture of fuel/air entrained in the water stream. Coordinated variation of the water and gas flow under computer control provided a dynamic display while maintaining the flame throughout the variations. Other features are disclosed.

DETAILED DESCRIPTION OF THE INVENTION

Figure 1:
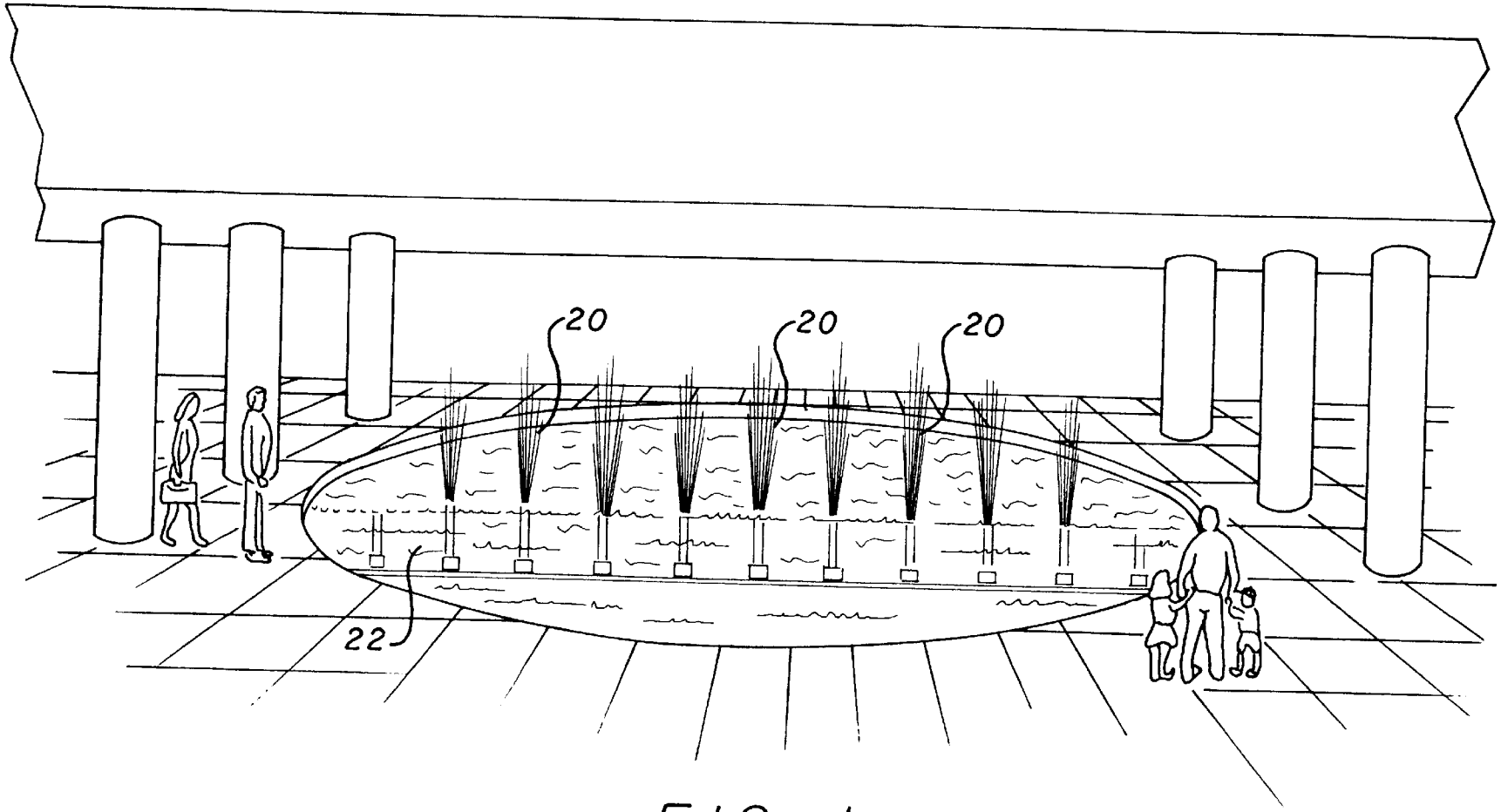
FIG. 1 is a perspective view of an exemplary application of the present invention.

First referring to FIG. 1, a perspective view of an exemplary water display incorporating the present invention may be seen. In this Figure, nine individual displays 20 are shown distributed within a pool of water 22. These individual displays are characterized by an upwardly projecting stream of frothy water, though the gas creating the frothy appearance is actually a burning mixture of natural gas and air to create the illusion that the upward projecting stream of water itself is on fire. In the preferred embodiment, the burning stream of water may project typically five or six feet above the surface of the pool in a reasonably well-confined column on the order of 6 inches in diameter.

Figure 2:
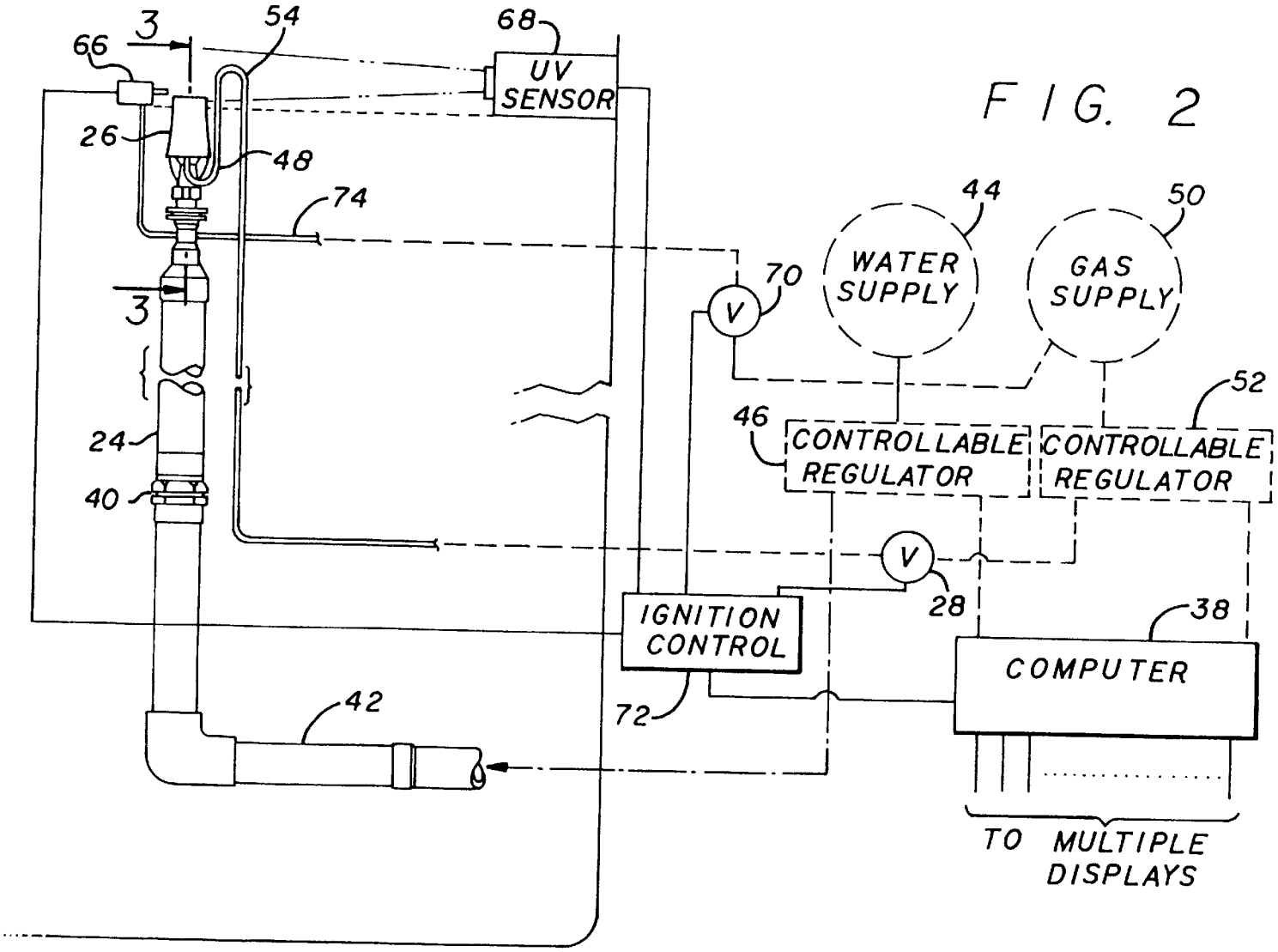
FIG. 2 is a diagram illustrating exemplary structure and control for the water displays of FIG. 1.

Now referring to FIG. 2, a diagram illustrating a typical system and the apparatus for one of the individual displays may be seen. Anchored to the bottom of the pool is a vertical tubular structure 24 having a self-entraining nozzle 26 mounted on the top thereof. Coupled to the vertical tubular assembly 24 is a one-way valve 40, in turn coupled through water supply line 42 to a pressurized water supply 44 through a controllable regulator 46, the regulator also being controlled by computer 38.

The self-entraining nozzle 26 has a supply of gas provided thereto through gas line 48, coupled to a gas supply 50 through an on/off safety valve 28 and a controllable regulator S2. The gas line 48 has an inverted U-shaped section 54 reaching sufficiently above the surface of the pool to assure that the gas line does not fill with water when the controllable regulator 52 is turned off.

Figure 3:
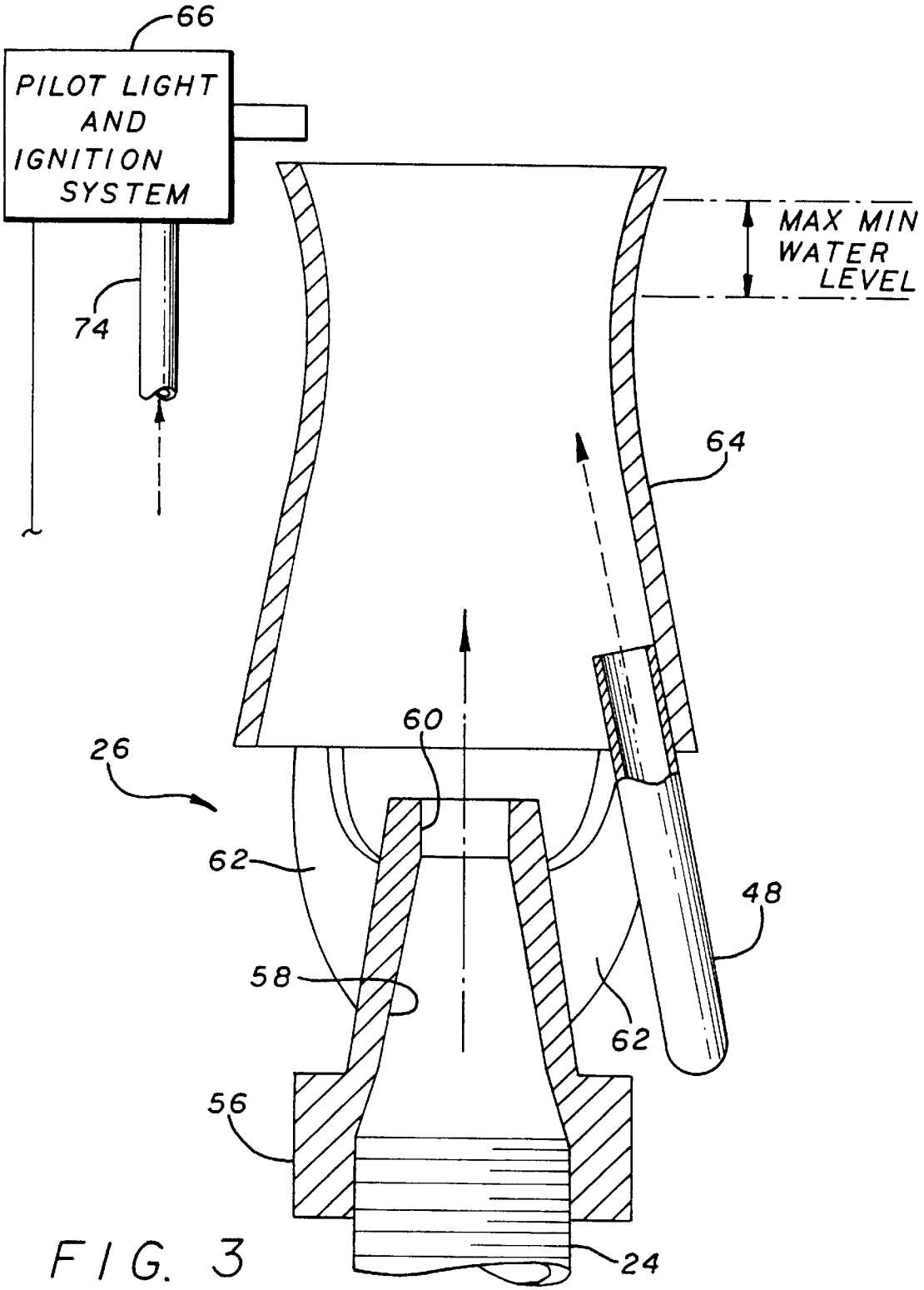
FIG. 3 is a partial cross section along line 3—3 of FIG. 2 of an exemplary self entraining nozzle 26.

Now referring to FIG. 3, a cross-section of a representative self-entraining nozzle 26 may be seen. Such nozzles typically include a nozzle base member 56 internally threaded for threading onto a tubular member such as tubular structure 24 and defining an internal nozzle region 58 with nozzle opening 60 for expelling water therefrom. Supported from the base member 56 and the region thereof defining the nozzle 58 are a plurality of support members 62, typically three or four in number, in turn supporting a Venturi member 64 of circular cross-section.

In operation, such self-entraining nozzles are placed in a pool with the top of the nozzle above the surface of the pool, so that when an appropriate stream of water is forced through the nozzle, the original water in the Venturi 64 will be expelled, and water flowing under the bottom edge of the Venturi 64 and the air sucked in with that water will become entrained in the stream of water being ejected by the nozzle to provide the frothy stream herein before described. In the present invention, however, the gas line 48 has been added, the gas line injecting gas through the base of Venturi 64 so that gas, together with air, becomes entrained in the stream ejected by the self-entraining nozzle. By appropriate adjustment of the gas flow relative to other parameters such as the rate at which water is ejected from the nozzle and the level of water in the pool, the resulting gas/air mixture in the frothy stream may readily be controlled to provide a desired combustible mixture. In the preferred embodiment, the gas line 48 is a ½ inch outside diameter, thick wall tube. The vertical tubular structure 24 is a 1½ inch diameter tubular structure, the exit 60 of the nozzle is ⅝ inch in diameter, and the entire nozzle and Venturi is approximately 9 inches long. For best results, it has been found that for this combination, the pool water level should range from approximately level with the top of the Venturi 64 to approximately 1 inch below the top of the Venturi.

Also shown in FIGS. 2 and 3 is the ignitor 66 for the flammable gas/air mixture. The ignitor 66 includes a pilot system supplied with the combustible gas through gas line 74 from the gas supply through valve 70 controlled by the ignition control 72. Ignitors of various kinds for the ignition of flammable gas/air mixtures in prior art water fountains are well known. Accordingly, a suitable commercially available ignitor, safety valve, etc. combination may be readily selected by one skilled in the art for the specific water display configuration of interest. Suitable systems are readily available, for example, from Honeywell. In some installations, the water display may be ignited by other means, such as, by way of example, an adjacent flame burning all of the time.

In operation in the manner illustrated in FIG. 1, water is supplied through water supply line 42 from the water supply 44 at a pressure controlled by controllable regulator 46 under program control from computer 38 (see FIG. 2). At the same time, gas is supplied from gas supply 50 through controllable regulator 52, also controlled by computer 38, for injection through gas line 48 in a controlled proportion relative to the water flow, and more particularly to a controlled proportion to the air being entrained in the water stream so as to form a combustible mixture of water and air in the stream ejected by the self-entraining nozzle. Preferable, the entrained air and gas are between 110% of the lower explosive limit to 90% of the upper explosive limit. When the source of ignition contacts the fuel/air mixture exiting the self-entraining nozzle, the fuel/air mixture ignites, and will continue to burn without a continuous ignition source. The resulting effect is of a fountain of water which is burning throughout its envelope, with a color varying from transparent blue to orange, depending on the particular fuel and air/fuel mixture used. The computer program, of course, having control of the pressure of water in supply line 42 and of the flow of gas in gas supply line 48, may vary the water and gas flow with time in a manner to maintain the desired combustible gas/air mixture in the frothy water expelled from the self-entraining nozzle, so that a single such display will tend to grow and retreat as controlled by the computer. In the event the flame goes out for any reason, the same will be sensed by the UV sensor and the ignition control will close valve 28 to turn off the gas flow. A plurality of such displays as illustrated in FIG. 1 may form changing dynamic patterns forming different shapes, wave patterns and the like.

Practically any commercially available self-entraining nozzle may be utilized to produce this display. The process requires that the air, which is normally pulled into the water stream through a vacuum effect, be partially replaced with a variable source of fuel gas at a volume necessary to raise the pressure within the vacuum, and thereby reduce the air volume. In this manner, a stable fuel/air mixture can be established and maintained. Since self-entraining nozzles will entrain air into the stream any time they are operating, the combustible fuel is introduced into the area of the envelope which would display the highest relative vacuum (lowest pressure). The display may also be operated with the gas flow being turned off, such as during the daylight hours, or intermittently during regular operation.

The present invention provides a relatively low cost, unusual water display, having the further benefit of low heat output relative to the amount of fuel consumed. In that regard, nearly all of the heat output is taken up by the water in the stream. While the preferred embodiment has been described with respect to obtaining burning water streams on the order of 5 to 6 feet in height, the present invention has been tested in a number of configurations providing a water flame height of from 3 inches to an overall height of 20 feet. Thus, while the present invention has been disclosed and described with respect to a preferred embodiment thereof, it will be understood by those skilled in the art that various changes in form and detail may be made therein without departing from the spirit and scope of the invention.

What is claimed is:

1. A water display comprising:

a self entraining nozzle disposed in a body of water for entraining air in a water stream emitted by the nozzle;

a water supply coupled to the self entraining nozzle for delivering water under pressure to the nozzle;

a combustible gas supply coupled to the self entraining nozzle to deliver combustible gas to the self entraining nozzle at a rate selected to mix with the air being entrained by the self entraining nozzle to form a combustible mixture.

2. The water display of claim 1 wherein the combustible gas supply coupled to the self entraining nozzle to deliver the combustible gas to the self entraining nozzle adjacent the region of lowest pressure.

3. The water display of claim 1 further comprising a first controllable regulator coupled between the water supply and the self entraining nozzle, a second controllable regulator coupled between the combustible gas supply and the self entraining nozzle, and a computer coupled to the first and second regulators, wherein the water delivered to the self entraining nozzle is regulated under computer control, and the combustible gas delivered to the self entraining nozzle is regulated under computer control, the water and the gas being varied with time and regulated in coordination to maintain a combustible gas/air mixture entrained in the water flowing from the self entraining nozzle.

4. The water display of claim 3 wherein the top of the self entraining nozzle is approximately level with, to approximately one inch above the surface of the water.

5. A method of providing a water display comprising:

providing a self entraining nozzle disposed in a body of water for entraining air in a water stream emitted by the nozzle;

supplying water under pressure to the self entraining nozzle;

supplying combustible gas to the self entraining nozzle at a rate selected to mix the gas with the air being entrained in the water by the self entraining nozzle to form a combustible fuel/air mixture entrained in the water emitted by the nozzle; and, igniting the fuel/air mixture entrained in the water emitted by the nozzle.

6. The method of claim 5 wherein the combustible gas is supplied to the self entraining nozzle adjacent the region of lowest pressure.

7. The method of claim 5 wherein the water is supplied to the self entraining nozzle through a first controllable regulator, and the combustible gas is supplied to the self entraining nozzle through a second controllable regulator, the first and second regulators being controlled by a computer, wherein the water delivered to the self entraining nozzle is regulated under computer control, and the combustible gas delivered to the self entraining nozzle is regulated under computer control, the water and the gas flow being varied with time and variably regulated in coordination to maintain a combustible gas/air mixture entrained in the water flowing from the self entraining nozzle.

8. The method of claim 7 wherein the top of the self entraining nozzle is approximately level with, to approximately one inch above the surface of the water.

* * * * *